United States Patent [19]

Hutter et al.

[11] 3,934,171

[45] Jan. 20, 1976

[54] DOUBLE GRID ELECTRON GUN SYSTEM AND METHOD OF USE

[75] Inventors: Rudolf G. E. Hutter, New York, N.Y.; Herman O. Dressel, Lynnfield, Mass.

[73] Assignee: GTE Laboratories Incorporated, Waltham, Mass.

[22] Filed: May 28, 1974

[21] Appl. No.: 473,540

[52] U.S. Cl. ..... 315/30; 315/383

[51] Int. Cl.[2] ..... H01J 29/52

[58] Field of Search ..... 315/30, 386, 379, 383

[56] References Cited

UNITED STATES PATENTS

| | | | |
|---|---|---|---|
| 3,403,291 | 9/1968 | Lazarchick, Jr. et al. | 315/30 |
| 3,417,199 | 12/1968 | Yoshida et al. | 315/30 |

*Primary Examiner*—T. H. Tubbesing

*Attorney, Agent, or Firm*—Irving M. Kriegsman; Leslie J. Hart

[57] ABSTRACT

An electron gun for use in a cathode-ray tube is provided with two control grids between the cathode and an accelerating electrode. The control grids are both provided with separate control voltages bearing the same intensity-modulation information for control of the electron beam from the cathode. The two control voltages are caused to vary, one according to a linear function of the variation of the other. When this linear function is caused to have a particular slope, the area of the cathode which emits the electron beam remains approximately constant over a wide range of control voltage.

5 Claims, 5 Drawing Figures

DOUBLE GRID ELECTRON GUN SYSTEM AND METHOD OF USE

BACKGROUND OF THE INVENTION

1. Field of the Invention

This invention relates to an electron gun of the type used principally in cathode-ray tubes.

2. Description of the Prior Art

A conventional prior art triode gun found in cathode-ray tubes consists of a cathode 2, a grid electrode 4 and an anode or accelerating electrode 6, as shown in FIG. 1. For discussion, the cathode is taken as a reference and is assumed to be at zero potential. The anode is at a positive potential and the grid is at a negative potential. This structure forms an electron beam 8 whose current can be controlled by varying the potential of the grid electrode, usually extending over a range from zero voltage for maximum beam current to a certain negative cut-off voltage for no beam current. A modification of this conventional gun is a tetrode gun, in which the anode is followed by another positive electrode, as in U.S. Pat. No. 2,276,320 to Linder and U.S. Pat. No. 2,939,703 to Niklas. This modification is not relevant to this discussion of prior art.

An important characteristic of an electron gun, especially of those used in television tubes, is the variation of the electron beam current $I_b$ with grid voltage $V_g$, or with "drive voltage", defined as $V_d = V_g - V_{gc}$ where $V_{gc}$ is the cut-off voltage.

A mathematically rigorous analysis for $I_b = f(V_d)$, taking into account the gun geometry, space-charge effects and aberrations, is only possible by means of computers. Several approximate methods have been used to derive relations of the type $$I_b = K\ V_d^{\alpha}\ V_{gc}^{\beta}$$

with exponents varying between 3/2 and 7/2. Measurements on experimental triodes by various investigators appear to confirm the theoretical predictions. The exponent $\alpha$ is usually referred to as the "gamma" of the characteristic. The value of gamma is fixed in conventional electron guns. By "fixed", it is not meant that it is absolutely constant, because the gamma is probably a slowly varying function of $V_d$ and is only approximately or substantially constant. However, the value of gamma is fixed in the sense of being predetermined in a conventional tube by the nature of the tube itself.

SUMMARY OF THE INVENTION

This invention relates to an electron gun in which the gamma may be varied by an adjustment of the operating conditions of the gun. Such an electron gun permits an electrically adjustable control of the area of the cathode surface which emits the electron beam in response to the drive voltage applied. This control is accomplished by varying the potential on the control grid nearest the cathode, which potential may be fixed at some chosen value to establish the emitting area, or preferably varied in synchronism with the drive voltage applied to the second control grid.

As a result of the above feature, it is possible to operate this electron gun, in a manner which requires tracking both grid voltages, such that the emitting area remains constant over most of control grid characteristic from zero bias to cutoff.

DESCRIPTION OF THE PREFERRED EMBODIMENT

Figure 1:
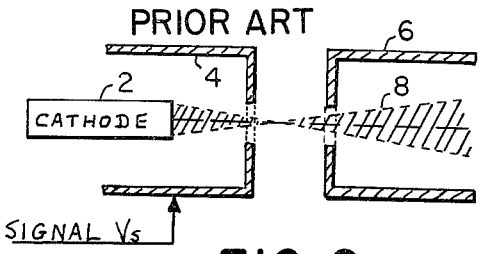
FIG. 1 PRIOR ART
FIG. 1 is a cross-sectional view of the beam-emitting section of a conventional prior-art electron gun.
Figure 2:
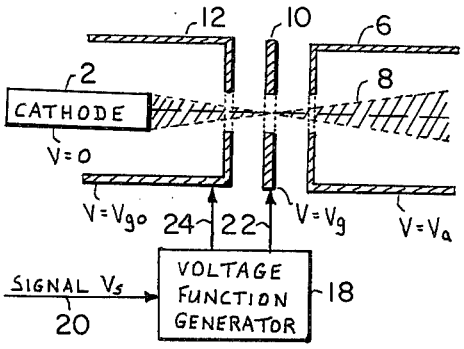
FIG. 2 is a cross-sectional view of the beam-emitting section of an electron gun according to the present invention.
Figure 3:
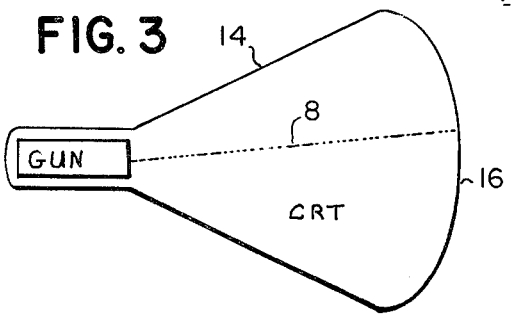
FIG. 3 is a cross-sectional view of such a gun installed in a cathode-ray tube.

In addition to a conventional control grid 10, corresponding to grid 4 in FIG. 1, the improved gun of FIG. 2 includes an auxiliary grid 12 between the cathode 2 and the accelerating electrode 6 in the path of beam 8. The gun is used, as shown in FIG. 3, in a cathode-ray tube (CRT) 14 to cause the beam 8 to trace an image on a screen 16. Further focusing, acceleration and deflection are preferably provided for use in a CRT. A voltage function generator 18 receives on line 20 a video signal $V_s$, which in the prior art device might have been applied directly to the only control grid to modulate the intensity of the beam. Generator 18 produces one control voltage $V_g$ on a line 22 for control of the conventional control grid 10 and produces another control voltage $V_{go}$ on a line 24 for control of the auxiliary control grid 12.

Figure 4:
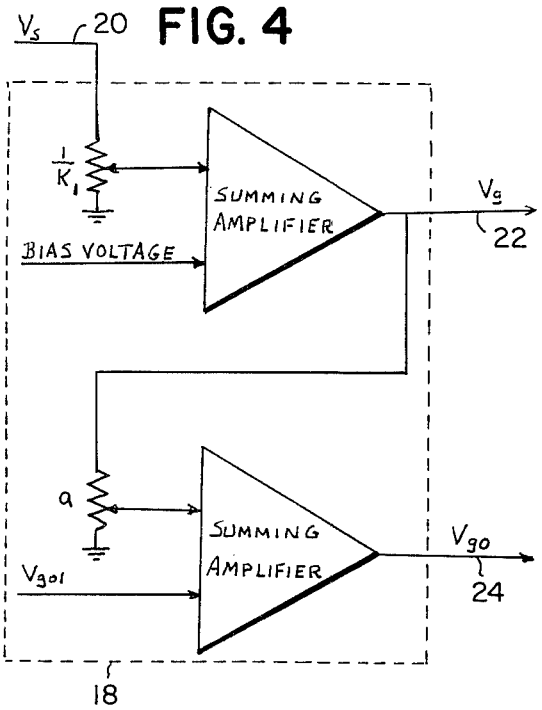
FIG. 4 is a schematic diagram of a linear function generator, the details of which form no part of the claimed invention, but which illustrates how a skilled artisan might choose to construct the function generator of FIG. 2.
Figure 5:
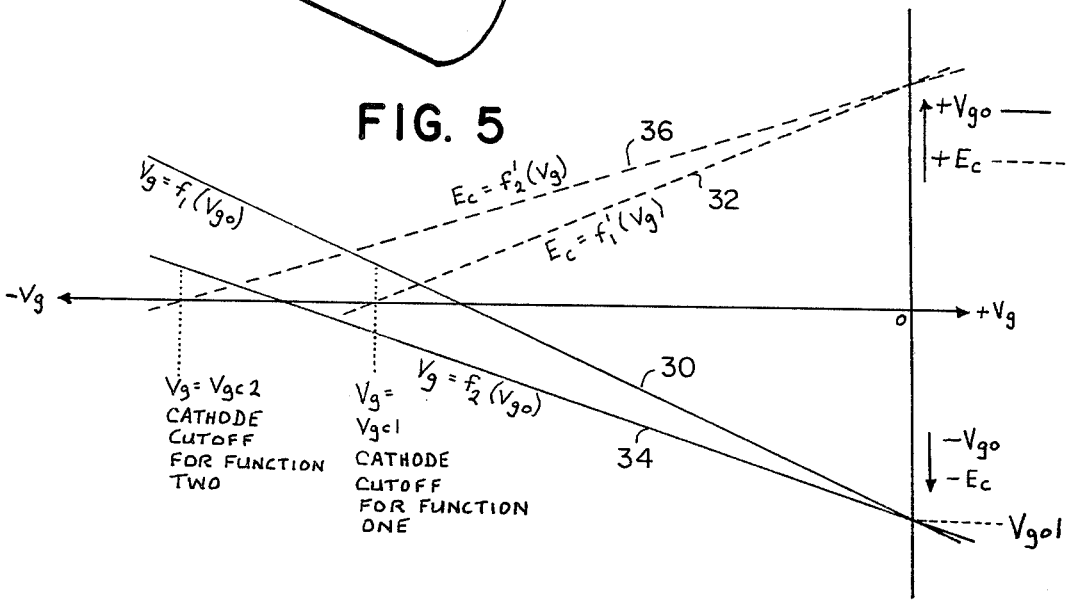
FIG. 5 is a graph showing, in solid lines, two different linear functions of the control voltage value on one control grid with respect to the control voltage value on the other control grid, and showing, in broken lines two corresponding linear functions of the resulting electrical field value at the cathode with respect to the control voltage value on the other grid.

FIG. 4 is provided, not as part of the claimed invention, but only as an example of how a skilled artisan might design a function generator 18 to put into effect the functions of FIG. 5.

In FIG. 5, a solid line 30 shows a graph of control voltage $V_g$ as a linear function one ($f_1$) of control voltage $V_{go}$, with $y$ intercept at $-V_{gol}$. A dotted or broken line 32 shows a graph of the electrical field at the cathode as a linear function ($f_1' \approx -$) of control voltage $V_g$. When the control voltage $V_g$ reaches a certain negative value $V_{gcl}$, the field $E_c$ at the cathode drops to zero and cutoff of the electron beam occurs. Throughout the linear range, $V_g$ becomes more negative as $V_{go}$ becomes more positive.

When the slope of the solid line (call the slope $a$) is changed and the y intercept $V_{gol}$ is unchanged, a new solid line 34 and a new broken line 36 are generated, representing a different set of operating conditions for the gun (call it function two or $f_2$). A new cathode cutoff point $V_{gc2}$ occurs. The $y$ intercept, representing the effective maximum beam current, remains at $V_{gol}$. However, because the functional dependence of the beam current on $V_g$ (i.e. transconductance) changes from curve 30 to curve 34, the gamma has been changed. There is, for example, some slope $a$, which may be found by observation or calculation for a particular gun arrangement, at which the gamma becomes such that the area of the cathode which emits the electron beam ramains approximately constant over a range of $V_g$ values.

In one mode of operation of the gun, the first grid 12, which operates with potential $V_{go}$, may remain at a fixed negative potential, in which case the gun operation resembles that of a normal triode geometry, but there is little advantage to such operation. The primary function of $V_{go}$ in such case would be to predetermine the emitting area by limiting the field penetration of the positive anode. This emitting area, which becomes maximum at zero control grid bias $V_g$, can therefore be electrically controlled. However, in the preferred embodiment, with proper linear tracking of both voltages, $V_{go}$ and $V_g$, the emitting area may be made to remain constant, or may be made to vary in a predetermined fashion over most of the control grid operating range.

In yet another mode of operation the gun may be operated with the same d.c. grid voltage applied to both grids. By proper spacings of the grid electrodes relative to the anode electrode, the emitting area operative at full grid drive can be predetermined and preset. In this mode of operation, a d.c. level corresponding to the control grid cutoff, such as $V_{gcl}$, is applied to both grids. Modulation is then applied only to the control grid (in a form which makes this grid appear less negative with respect to the cathode potential) in order to control the emission level and electron beam current.

In the preferred embodiment with operation according to FIG. 5, $V_{go}$ is derived as a linear function of $V_g$ with slope a and a y intercept at $V_{gol}$. In equation form:

$$V_{go} = V_{gol} + a\,V_g$$

The value of $V_g$ must be taken from $V_s$ as $V_s$ divided by some constant $K_1$, which could be 1 and may include a bias value $V_{bias}$ to preset an operating point. Depending upon the source of $V_s$, the value of $V_{bias}$ could be zero. Thus:

$$V_g = V_{bias} + (V_s/K_1)$$

The circuit of FIG. 4 mechanizes these two equations to derive $V_g$ and $V_{go}$ from $V_s$.

We claim:

1. An electron gun system comprising

A. a cathode for emitting an electron beam,

B. an accelerating grid having a positive grid having a positive voltage impressed thereon with respect to the cathode for accelerating the electron beam, C. first and second control grids located in the path of the electron beam between the cathode and the accelerating grid, and D. means responsive to an input control signal bearing information concerning the desired intensity of the electron beam for generating first and second control voltages both bearing said information and for respectively applying the first and second control voltages to the first and second control grids, whereby the first and second control grids jointly control the intensity of the electron beam emitted from the cathode.

2. An electron gun system according to claim 1 mounted in a cathode-ray tube, wherein the intensity of the electron beam controls the brightness of a portion of the image on a screen of the cathode-ray tube.

3. An electron gun system according to claim 1 wherein the generating means generates the first and second control voltages such that the one control voltage is a linear function of the other control voltage, one control voltage becoming more negative as the other becomes more positive.

4. An electron gun system according to claim 3 wherein the slope of said linear function is chosen to cause the area of the cathode which emits the electron beam to remain substantially constant over a range of control values.

5. The method of operating an electron gun system comprising a cathode for emitting an electron beam, an accelerating grid for accelerating the electron beam, and first and second control grids for controlling the intensity of the electron beam, comprising the steps of:

A. receiving variable input control signal bearing information concerning various desired intensities of the electron beam over the range of the input control signal, B. generating, from the input control signal, first and second control voltages which, when applied respectively to the first and second control grids, will cause the electron beam to have said desired intensities, one control voltage varying as a linear function of the other control voltage when the input control signal varies, C. adjusting the slope of the linear function to cause the area of the cathode which emits the electron beam to remain approximately constant over the range of the input control signal, and D. applying the first and second control voltages respectively to the first and second control grids.

* * * * *

UNITED STATES PATENT OFFICE

CERTIFICATE OF CORRECTION

Patent No. 3,934,171 Dated January 20, 1976

Inventor(s) Rudolf G. E. Hutter/Herman O. Dressel

It is certified that error appears in the above-identified patent and that said Letters Patent are hereby corrected as shown below:

Column 2, line 49, delete "($f_1$' ≈ —)" and insert --($f_1$')--.

Signed and Sealed this twentieth Day of April 1976

[SEAL]

Attest:

RUTH C. MASON
*Attesting Officer*

C. MARSHALL DANN
*Commissioner of Patents and Trademarks*